US005848903A

United States Patent [19]

Gammenthaler

[11] Patent Number: 5,848,903

[45] **Date of Patent: *Dec. 15, 1998**

[54] FLAT PIN CONNECTOR FOR ELECTRONIC CIRCUIT BOARDS

[75] Inventor: Peter Gammenthaler, Hittnau, Switzerland

[73] Assignee: Melcher AG, Uster, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 912,292

[22] Filed: Aug. 15, 1997

Related U.S. Application Data

[63] Continuation of Ser. No. 244,023, filed as PCT/CH93/00022, Jan. 28, 1993 published as WO94/07281, Mar. 31, 1994, abandoned.

[30] Foreign Application Priority Data

Sep. 14, 1992 [CH] Switzerland ..... 2883/92-5

[51] Int. Cl.[6] ..... H01R 9/09

[52] U.S. Cl. ..... 439/79

[58] Field of Search ..... 439/79, 80, 573, 439/564, 76.1

[56] References Cited

U.S. PATENT DOCUMENTS

| | | | |
|---|---|---|---|
| 4,950,169 | 8/1990 | Martin et al. | 439/44 |
| 5,249,974 | 10/1993 | Wang | 439/79 |
| 5,340,320 | 8/1994 | Puerner | 439/79 |
| 5,482,470 | 1/1996 | Atsumi et al. | 439/246 |
| 5,496,183 | 3/1996 | Soes et al. | 439/79 |
| 5,504,994 | 4/1996 | Banakis et al. | 439/79 |
| 5,584,709 | 12/1996 | Kiat | 439/79 |
| 5,622,508 | 4/1997 | Nagahata et al. | 439/79 |
| 5,667,392 | 9/1997 | Kocher et al. | 439/79 |

OTHER PUBLICATIONS

B1 Document No. DIN 41 494, Date—Unknown, Country—Germany.

B2 Document No. DIN 41 612, Date—Unknown, Country—Germany.

*Primary Examiner*—Gary F. Paumen

*Attorney, Agent, or Firm*—Jenkens & Gilchrist, P.C.

[57] ABSTRACT

A socket (1) forms part of a flat-pin connector designed for 19" racks. Mounted on it by means of soldering tabs (3) is a standard circuit board (2) which is fitted in a housing (9). The housing (9) has two parallel walls (13,14) and is closed off from the socket by a half-frame (16). The part of the socket (1) facing towards the circuit board (2) has a central section (6) which not only carries the soldering tabs (3) but also acts as a stop for the circuit board (2). The dimensions and position of this central section (6) are such that the housing wall (13) which covers the solder side of the circuit board does not extend out more than a distance defined by the distance between the pin array and the side of the socket (1), so that the whole of the rest of the width comprising distances is available for components and the other wall (14). The space available for components can be further increased by providing over the shoulder (10) as recess (12) which allows the circuit board (2) to be mechanically fixed in place by means of rivets or bolts passing through a hole (11).

5 Claims, 3 Drawing Sheets

FLAT PIN CONNECTOR FOR ELECTRONIC CIRCUIT BOARDS

This application is a continuation of pending application Ser. No. 08/244,023, filed as PCT/CH93/00022, Jan. 28, 1993 published as WO94/07281, Mar. 31, 1994, now abandoned.

BACKGROUND

This invention is concerning a flat pin connector for electronic circuit boards used in 19 inch assembly carriers.

A flat pin connector consists of a male multipoint connector and its counterpart, the female multipoint connector. These female and male multipoint connectors are conventional products and used in many applications. They have been standardized in order to rationalize construction and production, e.g. by DIN 41 612. The standardization of the circuit boards, the housing, and the unit carrier with its corresponding grid (DIN 41 494) results in a standardized system that has proven to be rather useful.

The construction features of the male multipoint connectors are determined by its two sides: the side of the male multipoint contacts (contact side), which have to dimensionally correspond with the corresponding female multipoint connectors, and by the side that is used for the connection of electronic components to the male multipoint connectors, which are usually assembled on circuit boards (circuit board side).

The standard for male multipoint connectors as a base for an open circuit board and its insertion into a 19 inch assembly carrier has proven particularly successful.

If such a circuit board is to also carry a screen plate or to be integrated into a housing (cassette), it turns out that the standardized male multipoint connectors offered by several manufacturers complicate optimum solutions. The development of state of the art electronics often demands use of minimum space, i.e. making optimum use of the space determined by the grid. The standardized male multipoint connectors that are currently available have turned out to be a handicap for this kind of construction. These handicaps are further illustrated in connection with FIG. 1.

SUMMARY

The purpose of this invention is the development of a male multipoint connector that will solve the problems which come into existence when the male multipoint connector is equipped with a circuit board and screen or if it is installed with a circuit board into a housing.

In one embodiment, the present invention comprises a male multipoint connector for installation into a 19 inch assembly carrier, which has on one side, the contact side, fifteen male multipoint contacts (7) for the connection with a dimensionally corresponding female multipoint connector and on its other side, the circuit board side, fifteen tag pins (3) that are used for the attachment of a circuit board (2) by means of soldering, with the connector corresponding in its width diagonally to the male multipoint contacts (7) and in its length, in the direction of the male multipoint contacts (7) and with the formal and dimensional design of that side which allows for the plug-in connection with the female multipoint connector, with design H according to DIN 41 612, with said male multipoint connector having on its circuit board side a center part (6) with fifteen contact tabs that serves on its one side as an anchor for the circuit board (2), and with these contact tabs equipped with the male multipoint contacts (7) on one side and with the tag pins (3) on the other side, it is characterized by the fact that the distance between the edge of the male multipoint connector and that side of the center part (6) serving as an anchor for the circuit board (2) is designed in such a way that it equals the sum of the thickness of a circuit board (2), the length of a soldering tag protrusion according to DIN 41 494, the tolerance value T according to DIN 41 494, and the thickness of a metal plate.

In a further embodiment, the present invention includes the metal plate being a screen plate (5). In yet a further embodiment, the present invention includes the tag pins (3), with regard to their distance from the male multipoint contacts (7), being arranged in two rows designed in a staggered manner.

In another further embodiment, the present invention includes the metal plate being the wall (13) of a metal housing (9). In yet a further embodiment, the present invention includes the tag pins (3), with regard to their distance from the male multipoint contacts (7), being arranged in two rows designed in a staggered manner.

In another further embodiment, the present invention includes the tag pins (3) from the male multipoint contacts (7) being smaller than that in the standard version.

BRIEF DESCRIPTION OF THE DRAWINGS

Further explanations of the inventive idea are given by the enclosed illustrations.

DETAILED DESCRIPTION

Figure 1:
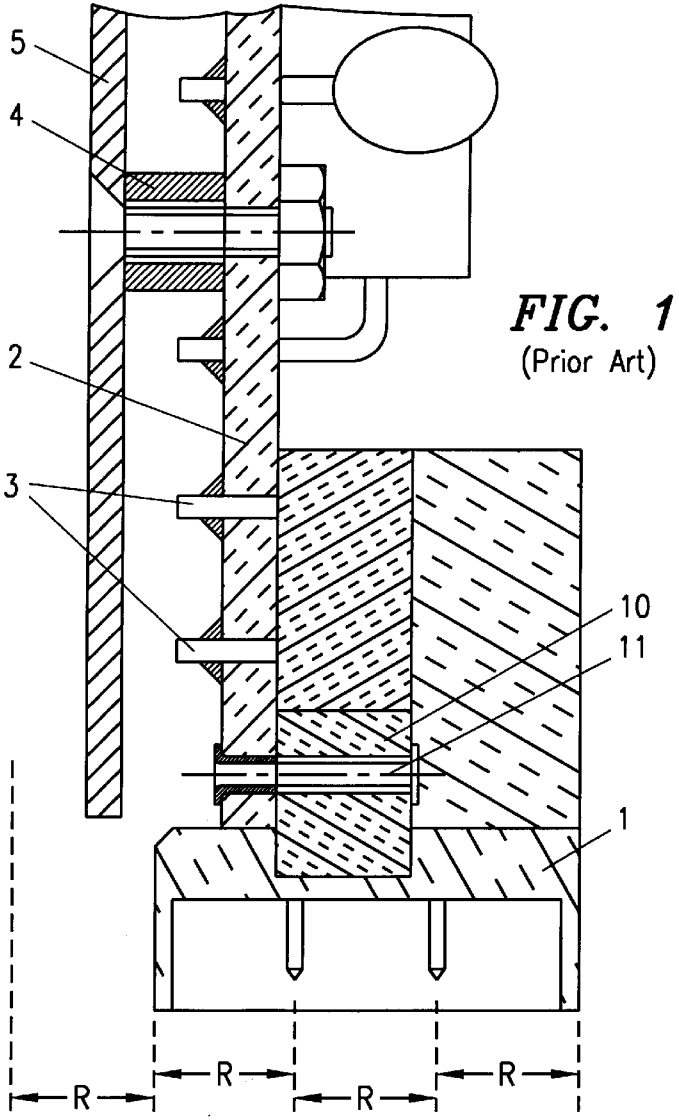
FIG. 1 (Prior Art)
FIG. 1 a partially cutaway, lateral view of a conventional male multipoint connector with circuit board and screen plate, FIG. 2 an illustration corresponding FIG. 1 of the male multipoint connector with circuit board and screen plate according to this invention, FIG. 3*a* a plan view of a standardized male multipoint connector as viewed from the bottom side of the circuit board, FIG. 3*b* a plan view of a male multipoint connector according to this invention as viewed from the bottom side of the circuit board, FIG. 4 a variation of FIG. 2, FIG. 5 a plan view of the design example illustrated in FIG. 4 as viewed from the contact side.

FIG. 1 schematically illustrates a cross section of a standardized male multipoint connector 1 in an H design according to DIN 41 612 containing a circuit board 2. The plug-in position and the needed space of such a male multipoint connector 1 are standardized and determined by a consistently used grid R. The male multipoint connector 1 shown in this figure, requires three grid units R, as illustrated in the lateral view of FIG. 1. The circuit board 2 is soldered to the tag pins 3. It might contain a screen plate 5 by means of several spacers 4 (of which only one is shown in FIG. 1) in order to screen the circuits on the circuit board 2. The distance between the circuit board 2 and the screen plate 5 is equal to the protrusion of the soldering tag pins (3) plus a tolerance T according to DIN 41 494, which results in a projection of the screen plate 5 into the next grid space. The grid lines with a standardized space of R are represented by dashed lines in FIG. 1. The projection of the screen plate 5 causes a shifting of the male multipoint connector 1 by the grid space R, even if the components on the circuit board 2 do not fully cover the number of grid spaces required by their height. This results in the loss of grid space R, when compared with the tightest design possible.

Figure 2:
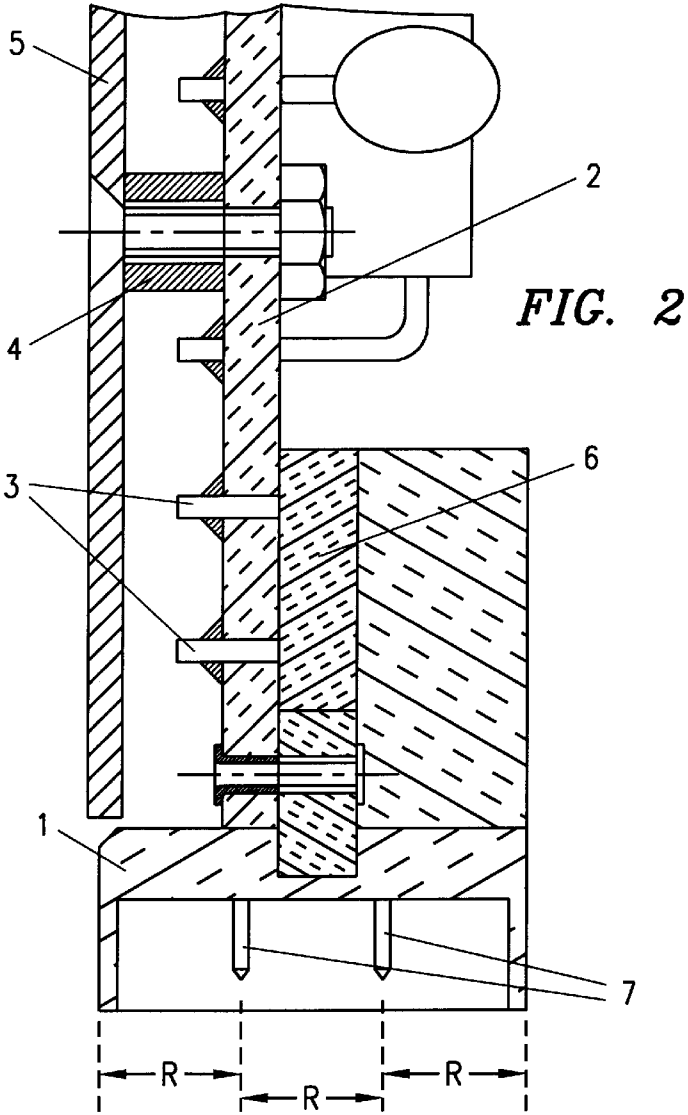

FIG. 2 illustrates a section similar to FIG. 1 of the inventive solution. While the contact side of the male multipoint connector 1 remains unchanged (in particular, the dimension, number and position of the male multipoint contacts 7 is according to standard), the circuit board side of the male multipoint connector deviates from the standard: a center part, referenced by number 6, whose one side contains the circuit board 2 and the contact tabs, which in turn contain the male multipoint contacts 7 on the bottom and the tag pins 3 on the top, is narrower than the standardized DIN version. In the design example according to FIG. 2, it is reduced by the thickness of the screen plate that in FIG. 2 is mainly flush with the bottom part of the male multipoint connector 1 and, thus, remains within the standardized width of the male multipoint connector 1 of 3R.

Figure 3A:
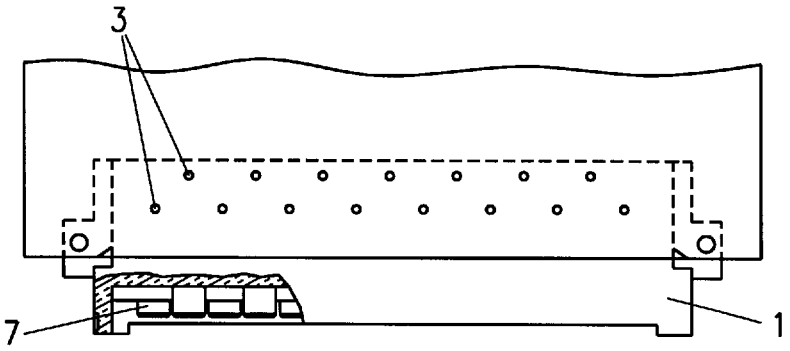
FIG. 3a (Prior Art)

FIG. 3*a* is the plan view of a standardized male multipoint connector 1. Even the position of the tag pins 3 in this design example is according to the standard. Even though economic reasons (tool costs) might favor such a solution, it is not necessarily a must for this invention. Standardization is used to ensure that the connection of instruments, components, and assemblies from different manufacturers are compatible. But if a manufacturer of a particular electronic assembly or functional unit has special requirements concerning the design of the circuit board side, the deviation from the standard can be rather useful.

Figure 3B:
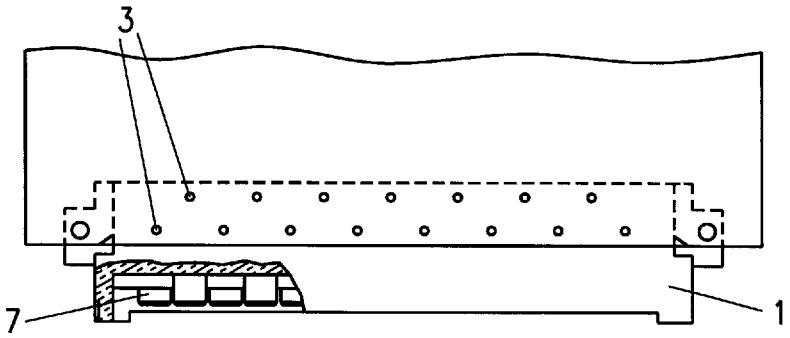

FIG. 3*b* illustrates a variation from the standard with regard to the arrangement of the tag pins 3. The distance between two rows of tag pins 3, which are arranged in a staggered pattern, from the male multiple contacts 7 is shorter than required by the standard. If the size and dimension of the circuit board 2 still corresponds with the standard (which is rather practical), the tags for the tag pins 3 can be shifted further to the edge of the circuit board 2. This results in an increase of space on the circuit board 2 that will be available for other components.

Figure 5:
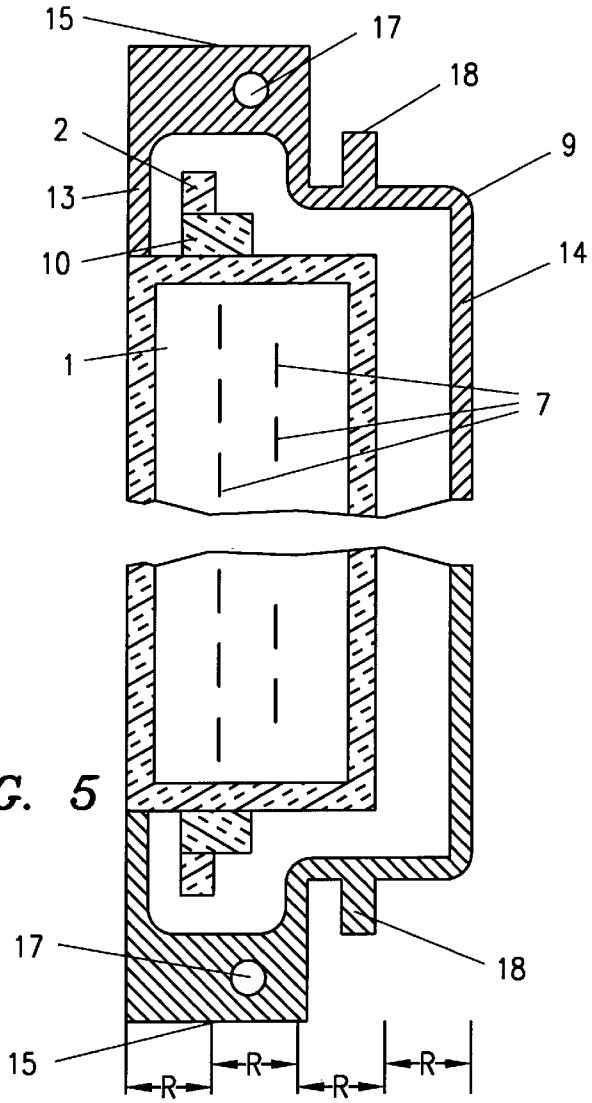
Figure 4:
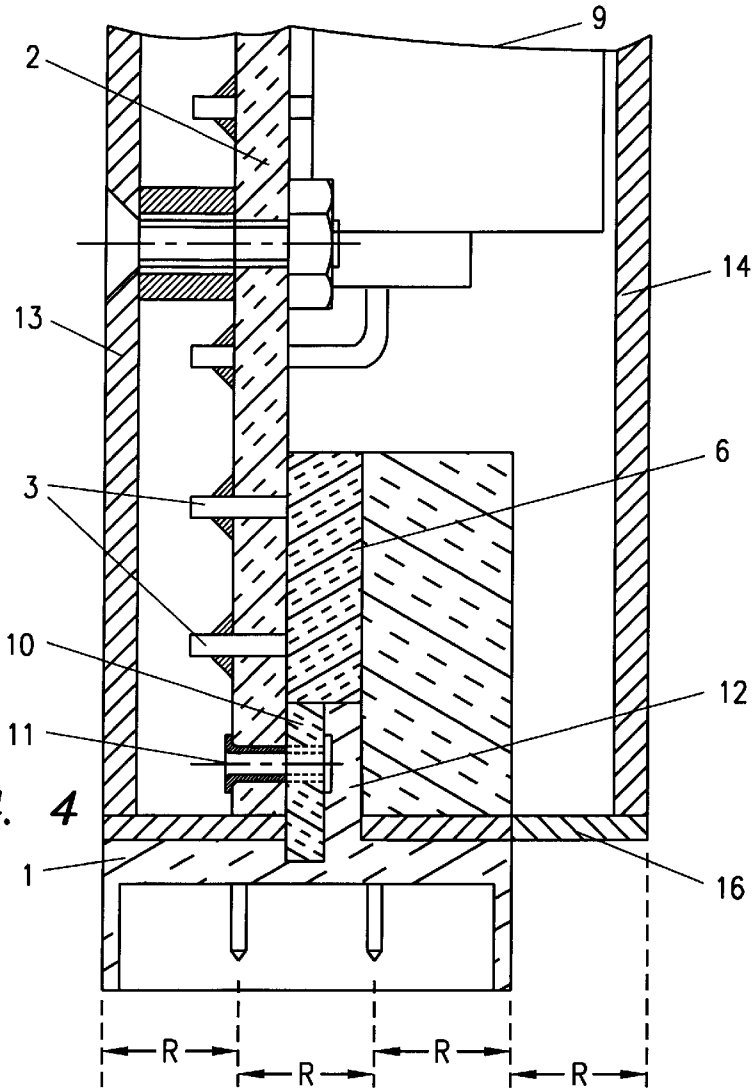

FIG. 4 illustrates the use of a variation of the inventive male multipoint connector 1 in connection with a metal housing 9 surrounding the circuit board 2. The male multipoint connector 1 is equipped with a shoulder 10 and an opening 11—also illustrated in FIGS. 1 and 2—which allows for the mechanical friction-type connection of the circuit board 2 by means of screws or rivets. In FIGS. 2 and 3, this shoulder 10 and the center part 6 are shorter than the standard. In the design example according to FIG. 4, the shoulder is even further shortened by attachment of a protrusion 12 and, thus, fits into the housing 9, which—as shown in FIG. 5—can consist of a flat pipe with two flat and parallel walls 13, 14 that run parallel to the circuit board 2; wall 13 on the soldering side and wall 14 on the component side of the circuit board 2. The housing 9 might be equipped with a cover (not shown) that can either be screwed on or welded onto the housing. The cover for the male multipoint connector 1 is a half-frame that can be screwed on. An insulating interlayer prevents the wall 13 (FIGS. 4, 5) and the screen plate (FIG. 2) from coming into contact with the soldering spots on the circuit board 2.

In this design example, the housing 9 protrudes over the male multipoint connector 1 by a grid unit R for demonstrative purposes. This number could also be 2R, 3R, nR according to the invention. It is important that the wall 13 of the housing 9 does not protrude over the male multipoint connector but that the excess is distributed over a number of grid units nR on one side and is available as an installation height. The use of a male multipoint connector according to this invention is also useful and practical, if either a screen plate 5 or the wall 13 of a housing 9—due to the components on the circuit board 2 or in the housing 9—is to protrude one or more whole grid units R on the opposite side, which is shown in FIG. 4 in a flush design, of the male multipoint connector 1 and if this cannot be accomplished with a conventional male multipoint connector without the waste of space.

FIG. 5, which shows the same design example as FIG. 4 from the side of the male multipoint contacts 7, clearly illustrates in which way the two walls 13, 14 are connected by means of two relatively sturdy ribs 15 equipped with an opening for the attachment of a half-frame 16 or of the cover (not shown). Each of the ribs 15 also carries a strip 18 that is used for inserting the housing 9 into the standardized plug-in unit.

What is claimed is:

1. An improved arrangement of a male multipoint connector in an H design mounted to a connector surface of a circuit board and said circuit board being secured to a plate, said plate having a predetermined plate thickness, and an exterior surface disposed away from said circuit board, said circuit board having a predetermined board thickness, said male multipoint connector including:

a contact side disposed away from and substantially perpendicular to the circuit board, a bottom part having an exterior surface disposed in the same direction as and substantially parallel to the exterior surface of the plate, a top part having an exterior surface disposed in the opposite direction from and substantially parallel to the exterior surface of the plate, a center portion disposed perpendicular to and away from the contact side, said center portion for anchoring the multipoint connector to the circuit board, said center portion having a circuit board side, and fifteen contact tabs, each of said contact tabs having a male multipoint contact extending out of said contact side and a soldering tag pin extending out of said circuit board side of said center portion for the mounting of said male multipoint connector to said circuit board and for protruding from said circuit board, said male multipoint contacts being arranged in a first row located a predetermined distance of R from a second row, said first row of male multipoint contacts being located the predetermined distance R from the exterior surface of said bottom part of said male multipoint connector, and said second row of said male multipoint contacts being located the predetermined distance R from the exterior surface of said top part of said male multipoint connector, said male multipoint contacts for connection with a dimensionally corresponding female multipoint connector, wherein the improvement of the male multipoint connector comprises:

the distance between said circuit board side of said center portion of said male multipoint connector and the exterior surface of said bottom part of said multipoint connector equaling the sum of the predetermined board thickness of said circuit board, the length of the soldering tag pin protruding from said circuit board a predetermined tolerance value, and the plate thickness of said plate, and the exterior surface of said top part of the multipoint connector being located three multiples of the predetermined distance of R from the exterior surface of the plate.

2. The improved arrangement according to claim 1, wherein said improvement further comprises said plate being a screen plate.

3. The improved arrangement according to claim 2, wherein said improvement further comprises said tag pins of said contact tabs of said male multipoint connector being arranged to extend out of said circuit board surface in two staggered rows.

4. An improved arrangement of a male multipoint connector in an H design mounted to a connector surface of a circuit board and said circuit board being secured to a housing, said housing having an upper wall with a top surface disposed away from and substantially parallel to said circuit board and said housing having a lower wall with a bottom surface disposed away from and substantially parallel to said circuit board, said lower wall of said housing having a predetermined wall thickness, said circuit board having a predetermined board thickness, said male multipoint connector including:

a contact side disposed away from and perpendicular to the circuit board, a bottom part having an exterior surface disposed in the same direction as and substantially parallel to the exterior surface of the lower wall of said housing, a top part having an exterior surface disposed in the opposite direction from and substantially parallel to the exterior surface of the lower wall, a center portion disposed perpendicular to and away from the contact side, said center portion for anchoring the multipoint connector to the circuit board, said center portion having a circuit board side, and fifteen contact tabs, each of said contact tabs having a male multipoint contact extending out of said contact side and a soldering tag pin extending out of said circuit board side of said center portion for the mounting of said male multipoint connector to said circuit board and for protruding from said circuit board, said male multipoint contacts being arranged in a first row located a predetermined distance of R from a second row, said first row of male multipoint contacts being located the predetermined distance R from the exterior surface of said bottom part of said male multipoint connector, and said second row of said male multipoint contacts being located the predetermined distance R from the exterior surface of said top part of said male multipoint connector, said male multipoint contacts for connection with a dimensionally corresponding female multipoint connector, wherein the improvement of the male multipoint connector comprises:

the distance between said circuit board side of said center portion of said male multipoint connector and the exterior surface of said bottom part of said multipoint connector equaling the sum of the predetermined board thickness of said circuit board, the length of the soldering tag pin protruding from said circuit board, a predetermined tolerance value, and the wall thickness of said lower wall of said housing, and said top surface of said upper wall of said housing being located an integer multiple, of the predetermined distance of R, from the exterior surface of the bottom part of said male multipoint connector.

5. The improved arrangement according to claim 4, wherein said improvement further comprises said tag pins of said contact tabs of said male multipoint connector being arranged to extend out of said circuit board surface in two staggered rows.

* * * * *